US006650036B2

(12) United States Patent
Nakagawa et al.

(10) Patent No.: US 6,650,036 B2
(45) Date of Patent: Nov. 18, 2003

(54) COLOR CATHODE RAY TUBE HAVING A RADIUS OF CURVATURE RATIO RELATIONSHIP

(75) Inventors: Shinichiro Nakagawa, Fukaya (JP); Yoshiaki Ito, Fukaya (JP); Takashi Murai, Fukaya (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/073,973

(22) Filed: Feb. 14, 2002

(65) Prior Publication Data

US 2002/0109451 A1 Aug. 15, 2002

(30) Foreign Application Priority Data

Feb. 15, 2001 (JP) ..... 2001-038023

(51) Int. Cl.[7] ..... H01J 29/80
(52) U.S. Cl. ..... 313/402; 313/408
(58) Field of Search ..... 313/402–408

(56) References Cited

U.S. PATENT DOCUMENTS

| | | | | |
|---|---|---|---|---|
| 4,697,119 A | | 9/1987 | Inoue et al. | |
| 4,881,004 A | | 11/1989 | Inoue et al. | |
| 4,887,001 A | * | 12/1989 | D'Amato et al. | 313/461 |
| 5,107,999 A | * | 4/1992 | Canevazzi | 220/2.1 A |
| 5,155,410 A | * | 10/1992 | Wakasono et al. | 313/402 |
| 5,416,379 A | | 5/1995 | Inoue et al. | |
| 5,631,520 A | | 5/1997 | Inoue et al. | |
| 5,663,610 A | | 9/1997 | Inoue et al. | |
| 6,025,676 A | | 2/2000 | Ohama et al. | |
| 6,066,914 A | | 5/2000 | Shimizu et al. | |
| 6,326,722 B1 | | 12/2001 | Shimizu et al. | |
| 6,333,594 B1 | | 12/2001 | Nakagawa et al. | |

FOREIGN PATENT DOCUMENTS

| | | | | |
|---|---|---|---|---|
| JP | 05036359 A | * | 2/1993 | ..... H01J/29/07 |
| JP | 9-245685 | | 9/1997 | |
| JP | 10-199436 | | 7/1998 | |
| JP | 11-242940 | | 9/1999 | |

* cited by examiner

*Primary Examiner*—Nimeshkumar D. Patel
*Assistant Examiner*—German Colón
(74) *Attorney, Agent, or Firm*—Oblon, Spivak, McClelland, Maierr & Neustadt, P.C.

(57) ABSTRACT

The outer surface of an effective portion of a panel is a substantially flat surface or a curved surface having some curvature. If the distances from the center of an effective surface of a shadow mask to the major- and minor-axis-direction ends are H and V, respectively, the effective surface is formed so as to fulfill relations $$2 \leqq RH1/RH2 \leqq 4 \text{ and } 1 < RV1/RV2 \leqq 1.47,$$

where RH1 is an average major-axis-direction curvature radius from the center of the effective surface to a midpoint in the major-axis direction, RH2 is an average major-axis-direction curvature radius from the center of the effective surface to the major-axis end portion, RV1 is an average minor-axis-direction curvature radius from the center of the effective surface to a midpoint in the minor-axis direction, and RV2 is an average minor-axis-direction curvature radius from the center of the effective surface to the minor-axis end portion.

4 Claims, 4 Drawing Sheets

COLOR CATHODE RAY TUBE HAVING A RADIUS OF CURVATURE RATIO RELATIONSHIP

CROSS-REFERENCE TO RELATED APPLICATIONS

This application is based upon and claims the benefit of priority from the prior Japanese Patent Application No. 2001-038023, filed Feb. 15, 2001, the entire contents of which are incorporated herein by reference.

BACKGROUND OF THE INVENTION

1. Field of the Invention

The present invention relates to a color cathode ray tube, and more particularly, to a color cathode ray tube in which the outer surface of an effective portion of a panel is substantially flat.

2. Description of the Related Art

For higher visibility, the outer surface of the effective portion of the panel of modern color cathode ray tubes tends to be flattened. As the outer surface of the effective portion becomes flatter, it is necessary to flatten the inner surface of the effective portion and the effective surface of a shadow mask that is opposed to a phosphor screen on the inner surface of the effective portion. Possibly, the effective surface of the shadow mask may be flattened by simply increasing the curvature radius of a conventional shadow mask that has a spherical effective surface. If high-density electron beams are emitted from an electron gun to display a high-intensity image, in this case, however, they run against the shadow mask, thereby causing the mask to undergo substantial local thermal expansion. Thus, the shadow mask bulges (or domes) toward the phosphor screen and causes lowering of color purity. Moreover, the curvature retention of the shadow mask may be lowered, so that the color cathode ray tubes can be deformed and rendered defective by impact or the like that acts thereon during their manufacture or transportation.

A panel is described in Jpn. Pat. Appln. KOKAI Publication No. 9-245685 as a measure to ease the above problems. The outer surface of the effective portion of this panel is flat, the major-axis-direction curvature radius of its inner surface is substantially infinite, and the minor-axis-direction curvature radius of the inner surface is substantially fixed. Described in Jpn. Pat. Appln. KOKAI Publication No. 10-199436, moreover, is a shadow mask that has an effective surface of the same configuration. Described in Jpn. Pat. Appln. KOKAI Publication No. 11-242940, furthermore, is a shadow mask of which the curvature is greater in the peripheral part of its effective surface.

The panel and each shadow mask described above have their respective specific effects against the aforesaid problems. In order to improve the visibility of the color cathode ray tube, however, the inner surface of the effective portion of the panel or the effective surface of the shadow mask must be further flattened. As for the shadow mask, moreover, it should be shaped so that it enjoys improved curvature retention.

BRIEF SUMMARY OF THE INVENTION

The present invention has been contrived in consideration of these circumstances, and its object is to provide a color cathode ray tube with improved visibility, in which the effective surface of a shadow mask has high curvature retention.

In order to achieve the above object, a color cathode ray tube according to an aspect of the invention comprises: an envelope including a panel having a substantially rectangular effective portion, the effective portion including an outer surface in the form of a substantially flat surface or a curved surface having some curvature; a phosphor screen on the inner surface of the effective portion; an electron gun configured to emit electron beams toward the phosphor screen; and a shadow mask located between the phosphor screen and the electron gun, the shadow mask including a substantially rectangular effective surface opposed to the phosphor screen and formed having a number of electron beam passage apertures, the effective surface having a major axis extending at right angles to a tube axis and a minor axis extending at right angles to the tube axis and the major axis and being formed of a curved surface convexed on the phosphor screen side.

The effective surface of the shadow mask is formed so as to fulfill relations:

$$2 \leqq RH1/RH2 \leqq 4, \text{ and}$$

$$1 < RV1/RV2 \leqq 1.47,$$

where H is the distance from the center of the effective surface of the shadow mask to the major-axis end portion of the effective surface, RH1 is an average major-axis-direction curvature radius of the effective surface on the major axis defined by a distance H/2 from the center of the effective surface to a midpoint in the major-axis direction and a fall ZH1 of the effective surface in the direction of the tube axis with respect to the center of the effective surface at the major-axis-direction midpoint, RH2 is an average major-axis-direction curvature radius on the major axis defined by a distance H and a fall ZH2 of the effective surface in the direction of the tube axis with respect to the center of the effective surface at the major-axis end portion, V is the distance from the center of the effective surface of the shadow mask to the minor-axis end portion of the effective surface, RV1 is an average minor-axis-direction curvature radius on the minor axis defined by a distance V/2 from the center of the effective surface to a midpoint in the minor-axis direction and a fall ZV1 in the direction of the tube axis with respect to the center of the effective surface at the minor-axis-direction midpoint, and RV2 is an average minor-axis-direction curvature radius on the minor axis defined by a distance V to the minor-axis end portion and a fall ZV2 in the direction of the tube axis with respect to the center of the effective surface at the minor-axis end portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
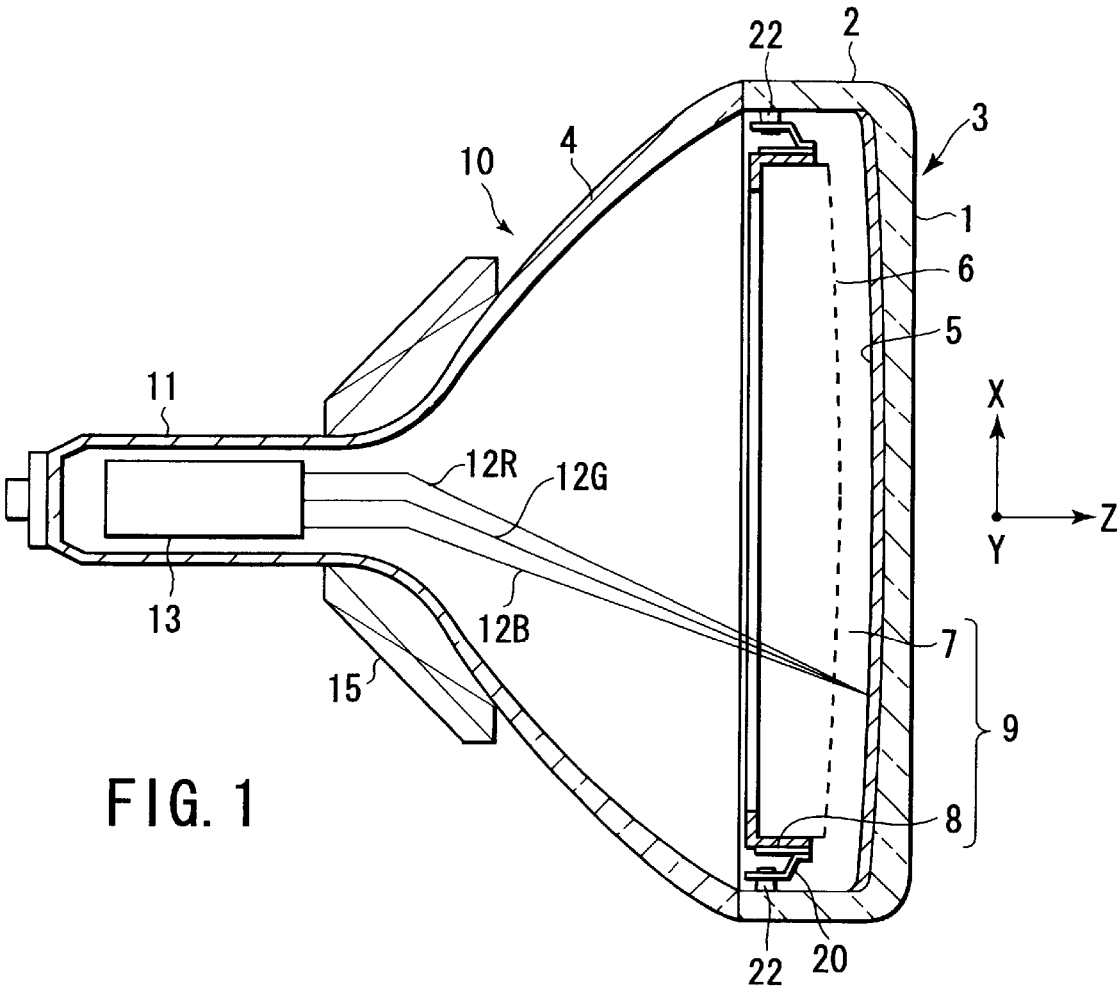
FIG. 1 is a sectional view showing a color cathode ray tube according to an embodiment of the invention.

As shown in FIG. 1, a color cathode ray tube according to an embodiment of the present invention comprises a vacuum envelope 10 that has a panel 3 and a funnel 4. The panel 3 includes a substantially rectangular effective portion 1 and a skirt portion 2 that is set up on the peripheral part of the effective portion. A phosphor screen 5, which is formed of three-color phosphor layers that glow blue, green, and red, individually, is provided on the inner surface of the effective portion 1 of the panel 3.

Inside the panel 3, moreover, a shadow mask 9 is opposed to the phosphor screen 5. The shadow mask 9 includes a mask body 7 having a substantially rectangular effective surface 6 and a mask frame 8 attached to the peripheral part of the mask body 7. A large number of electron beam passage apertures are formed in the effective surface 6 of the mask body 7. The shadow mask 9 is detachably supported on the panel 3 in a manner such that elastic supports 20 that are attached to the mask frame 8 are anchored individually to stud pins 22 on the inner surface of the skirt portion 2 of the panel. An electron gun 13 that emits three electron beams 12B, 12G and 12R is located in a neck 11 of a funnel 4.

In the color cathode ray tube, the three electron beams 12B, 12G and 12R from the electron gun 13 are deflected by means of magnetic fields that are generated by a deflector 15 on the outside of the funnel 4, and the phosphor screen 5 is scanned horizontally and vertically with the aid of the shadow mask 9. Thereupon, a color image is displayed.

For higher visibility, the outer surface of the effective portion 1 of the panel 3 is formed in the shape of a substantially flat surface having an average radius of diagonal curvature of 10,000 mm or more or a curved surface having some curvature. The inner surface of the effective portion 1 is formed as a curved surface corresponding to the effective surface 6 of the shadow mask 9 and is flat.

Figure 2:
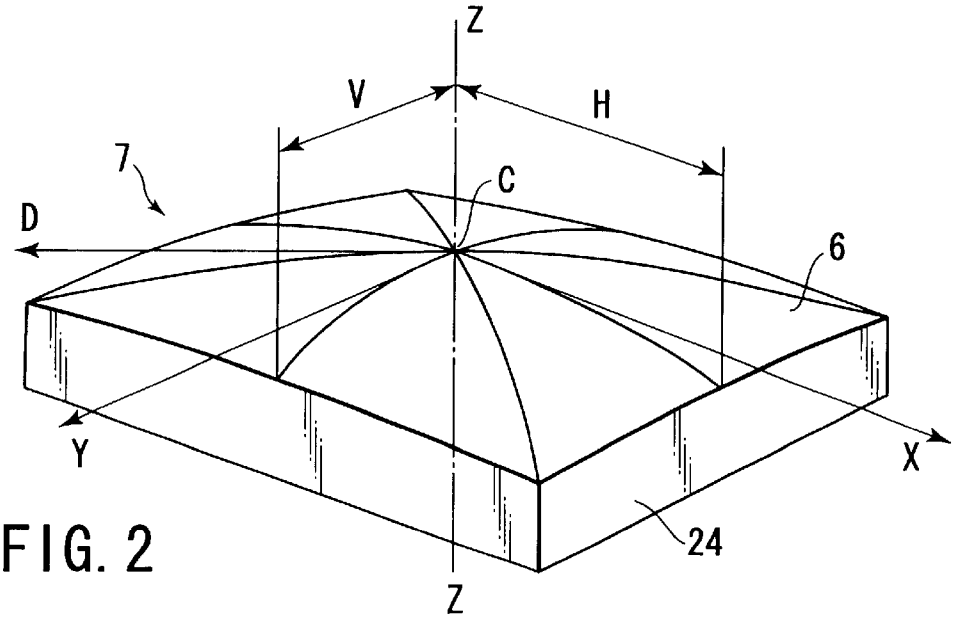
FIG. 2 is a perspective view schematically showing a shadow mask of the color cathode ray tube.

As shown in FIG. 2, the mask body 7 of the shadow mask 9 has the substantially rectangular effective surface 6 and a skirt portion 24 that is formed by bending the peripheral edge portion of the effective surface. The effective surface 6 is formed of a curved surface convexed on the phosphor screen side, and has a major axis (X-axis) and a minor axis (Y-axis) that extend at right angles to each other and to a tube axis Z. The distance from a mask center C to the major-axis end of the effective surface 6 and the distance from the center to the minor-axis end are given by H and V, respectively.

Figure 3:
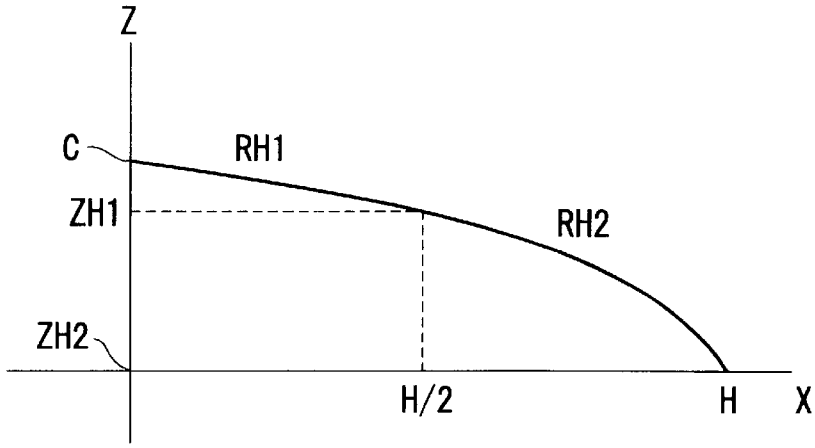
FIG. 3 is a diagram schematically showing a profile of the shadow mask along its major axis.

If the fall in the Z-direction of the mask body 7 at the X-direction midpoint (point at a distance H/2 from the mask center C) with respect to the mask center C is ZH1, as shown in FIG. 3, an average curvature radius RH1 in the major-axis direction X for the range from the center C to the midpoint H/2 in the major-axis direction Y is given by $$RH1=\{(ZH1)^2+(H/2)^2\}/(2\cdot ZH1).$$

Likewise, if the fall in the Z-direction of the mask body 7 at the X-direction end portion (point at a distance H from the mask center C) with respect to the mask center C is ZH2, an average curvature radius RH2 in the major-axis direction for the range from the center C to the X-direction end portion is given by $$RH2=\{(ZH2)^2+H^2\}/(2\cdot ZH2).$$

Figure 4:
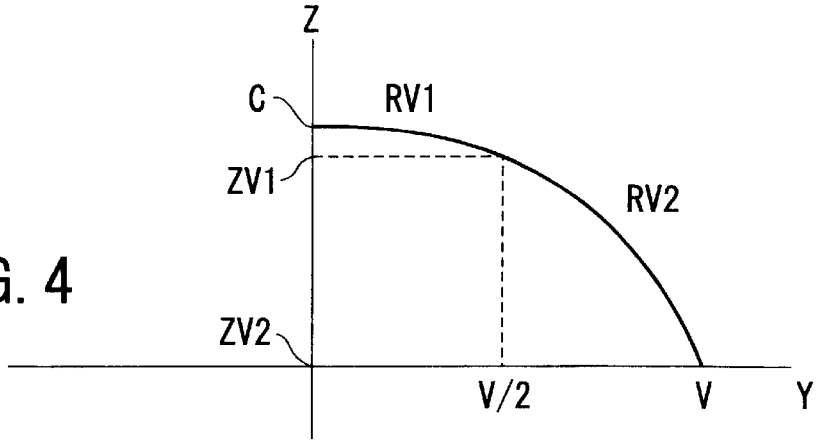
FIG. 4 is a diagram schematically showing a profile of the shadow mask along its minor axis.

If the fall in the Z-direction at the Y-direction midpoint (point at a distance V/2 from the mask center C) with respect to the mask center C is ZV1, as shown in FIG. 4, an average curvature radius RV1 in the minor-axis direction for the range from the center C to the midpoint V/2 in the minor-axis direction is given by $$RV1=\{(ZV1)^2+(V/2)^2\}/(2\cdot ZV1).$$

Likewise, if the fall at the Y-direction end portion (point at a distance V from the center) with respect to the mask center C is ZV2, an average curvature radius RV2 in the minor-axis direction for the range from the center to the Y-direction end portion is given by $$RV2=\{(ZV2)^2+V^2\}/(2\cdot ZV2).$$

In the case of the panel 3 having the flat outer surface and the curved inner surface, as described above, the increase of the thickness of the panel becomes greater as the distance from the panel center increases. In the case where the inner surface of the panel is spherical, moreover, there is a great difference in wall thickness between the major- and diagonal-axis ends of the panel. Thus, the flatness of the short-side portion of the screen, as viewed sideways, is ruined. Accordingly, the flatness of the short-side portion of the screen is improved by lessening the difference in the fall between the major- and diagonal-axis ends of the inner surface of the panel.

With this arrangement, the difference in the fall between the regions on the major axis and the long side of the panel is lessened, and the curvature radius in the minor-axis direction tends to be shorter in the peripheral part of the panel than in the central part. Therefore, it is to be desired, in the shadow mask formed corresponding to this panel, that local doming should be restrained by shortening the curvature radius of the peripheral part of the mask in the minor-axis direction.

According to the shadow mask 9 of the present embodiment, therefore, the curved surface of the mask body 7 is shaped flatter than a spherical shape (RH1/RH2=1) so that the major-axis-direction curvature radius on the major axis X is longer in the range from the mask center C to a middle portion halfway between the center C and the major-axis end. The peripheral part of the mask is shaped so that its major-axis-direction curvature radius on the major axis X is shorter than that of the central part of the mask body. By shaping the shadow mask 9 in this manner, the difference in the fall between the regions on the major axis and the long side can be lessened in the short-side peripheral part, and the curvature radius in the direction of the minor axis Y can be shortened.

The effective surface 6 of the mask body 7 is nearly flat in the range from the mask center C to the middle portion on the major axis X. In this case, the ratio between RH1 and RH2 preferably be set within the range given by $$2 \leqq RH1/RH2 \leqq 4.$$

If the ratio RH1/RH2 is lower than 2, the curvature radius in the direction of the minor axis Y is long in the peripheral part of the mask. In consequence, doming of the mask body 7 causes a substantial degree of mis-landing. If the ratio RH1/RH2 is higher than 4, on the other hand, the curvature retention of the region near the mask center is lowered.

A simulation was conducted such that the shadow mask 9 formed in the aforesaid manner was deformed by applying load (pressure) on the whole effective surface 6 of the mask. The load that caused the effective surface 6 to be deformed drastically was set as a buckling pressure, which was used as an index of the curvature retention of the shadow mask 9.

Figure 5:
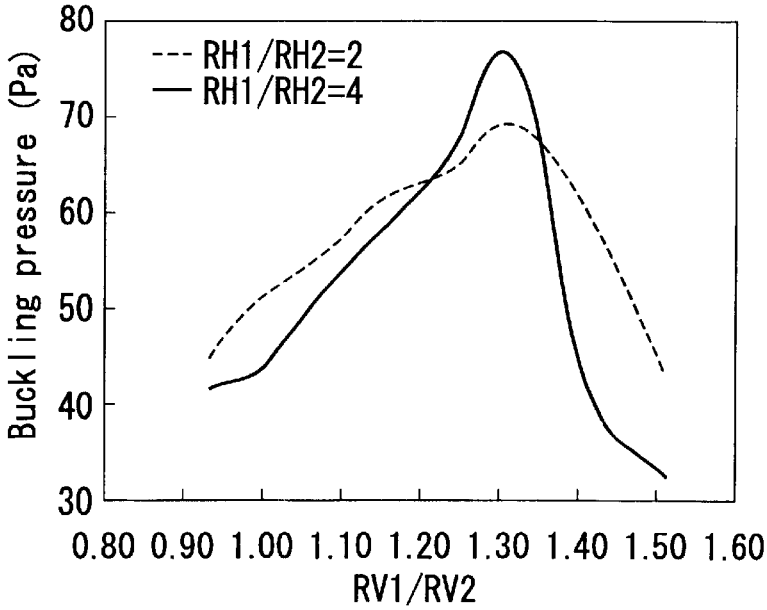
FIG. 5 shows characteristic curves representative of the relation between the curvature of the shadow mask and buckling pressure.

FIG. 5 shows the relation between the ratio RV1/RV2 and the buckling pressure for the shadow mask 9 designed so that the respective end portions of the major axis X, minor axis Y, and diagonal axes D of the effective surface 6 have the same fall in the Z-direction. In FIG. 5, a broken line represents the relation between the buckling pressure and the ratio RV1/RV2 that is obtained when the ratio RH1/RH2 is set at its lower limit value, 2, while a full line represents the relation between the buckling pressure and the ratio RV1/RV2 that is obtained when the ratio RH1/RH2 is set at its upper limit value, 4.

If the feasible range of the buckling pressure for products is adjusted to 50 Pa or more, the ratio RV1/RV2 ranges from 0.99 to 1.47 when RH1/RH2=2 is given and ranges from 1.06 to 1.39 when RH1/RH2=4 is given. Thus, the ratio RV1/RV2 preferably ranges as follows:

$$1 < RV1/RV2 \leqq 1.47.$$

Preferably, the minor-axis-direction curvature radius RV on the minor axis Y of the effective surface 6 monotonously decreases from the center of the effective surface 6 toward the minor-axis end, while the major-axis-direction curvature radius RH on the major axis X also monotonously decreases from the center of the effective surface 6 toward the major-axis end.

According to the color cathode ray tube having the shadow mask 9 constructed in this manner, the curvature retention of the effective surface 6 of the mask can be kept high enough if the effective portion 1 of the panel 3 is made flatter. Thus, the visibility of the color cathode ray tube can be improved.

The following is a description of examples of the shadow mask 9.

EXAMPLE 1

Figure 6:
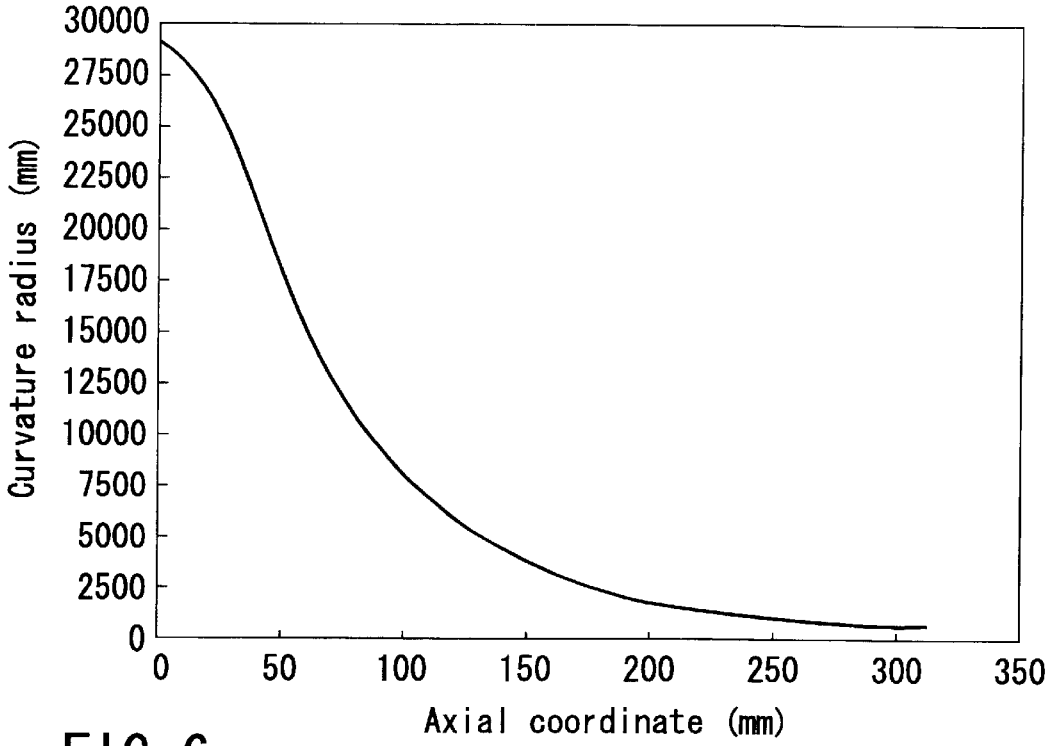
FIG. 6 is a diagram showing the major-axis-direction curvature radius of the shadow mask of the color cathode ray tube on its major axis.
Figure 7:
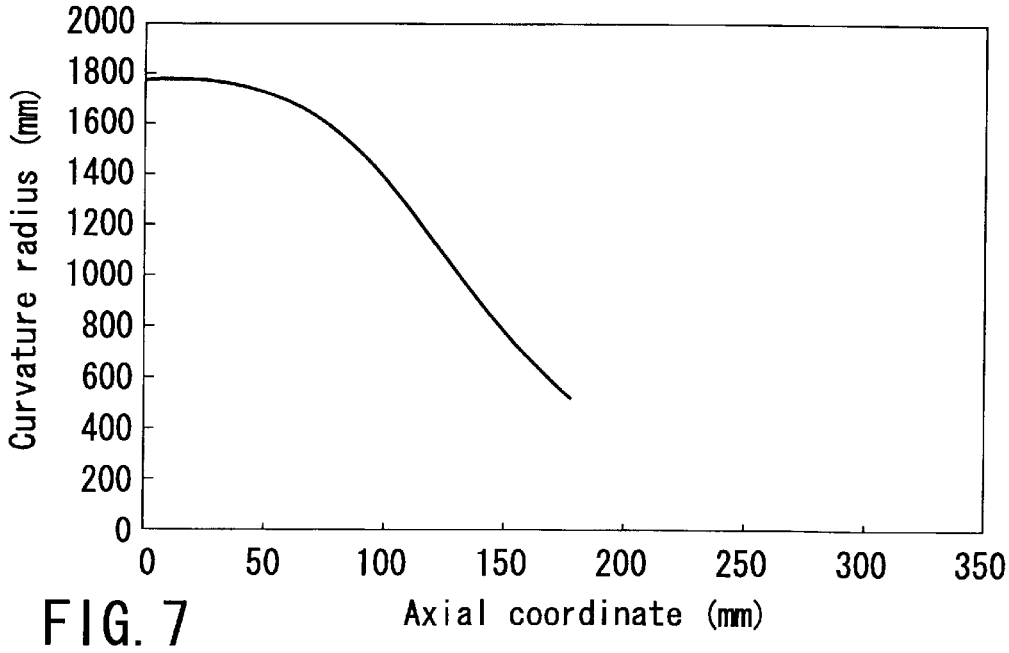
FIG. 7 is a diagram showing the minor-axis-direction curvature radius of the shadow mask on its minor axis.

This example is a shadow mask of a color cathode ray tube of the currently prevailing wide type, which is designed so that the aspect ratio of the effective portion 1 of the panel 3 is 16:9 and the diagonal length of the screen is 76 cm. FIG. 6 shows the major-axis-direction curvature radius of the effective surface 6 of the shadow mask 9 on the major axis X, and FIG. 7 shows the minor-axis-direction curvature radius on the minor axis Y.

The shadow mask 9 has a configuration such that the average curvature radius in the direction of the minor axis Y that passes the center C of the effective surface 6 is about 0.37 time as long as the average curvature radius in the major-axis direction.

The midpoints in the respective directions of the individual axes and the fall at the end portions are set as follows:

(direction of major axis X: distance H from center C to major-axis end=314 mm), fall ZH1 at major-axis-direction midpoint=1.0 mm, fall ZH2 at major-axis-direction end portion=12.3 mm, average major-axis-direction curvature radius RH1 for the range from center C to midpoint=12,325 mm, average major-axis-direction curvature radius RH2 for the range from center C to end portion=4,014 mm, (direction of minor axis Y: distance V from center C to minor-axis end=178 mm), fall ZV1 at minor-axis-direction midpoint=2.3 mm, fall ZV2 at minor-axis-direction end portion=10.8 mm, average minor-axis-direction curvature radius RV1 for the range from center C to midpoint=1,723 mm, average minor-axis-direction curvature radius RV2 for the range from center C to end portion=1,472 mm, (direction of diagonal axis: distance D from center C to diagonal-axis end=361 mm), fall ZD1 at diagonal-axis-direction midpoint=3.2 mm, fall ZD2 at diagonal-axis-direction end portion=15.1 mm, average diagonal-axis-direction curvature radius RD1 for the range from center C to midpoint=5,029 mm, and average diagonal-axis-direction curvature radius RD2 for the range from center C to end portion=4,323 mm.

According to this shadow mask, the ratios between the curvature radii in the respective directions of the individual axes are RH1/RH2=3.2 and RV1/RV2=1.2. In this case, the buckling pressure of the shadow mask is 71 Pa, which is higher than the reference value 50 Pa. Thus, the shadow mask has satisfactory curvature retention.

EXAMPLE 2

Figure 8:
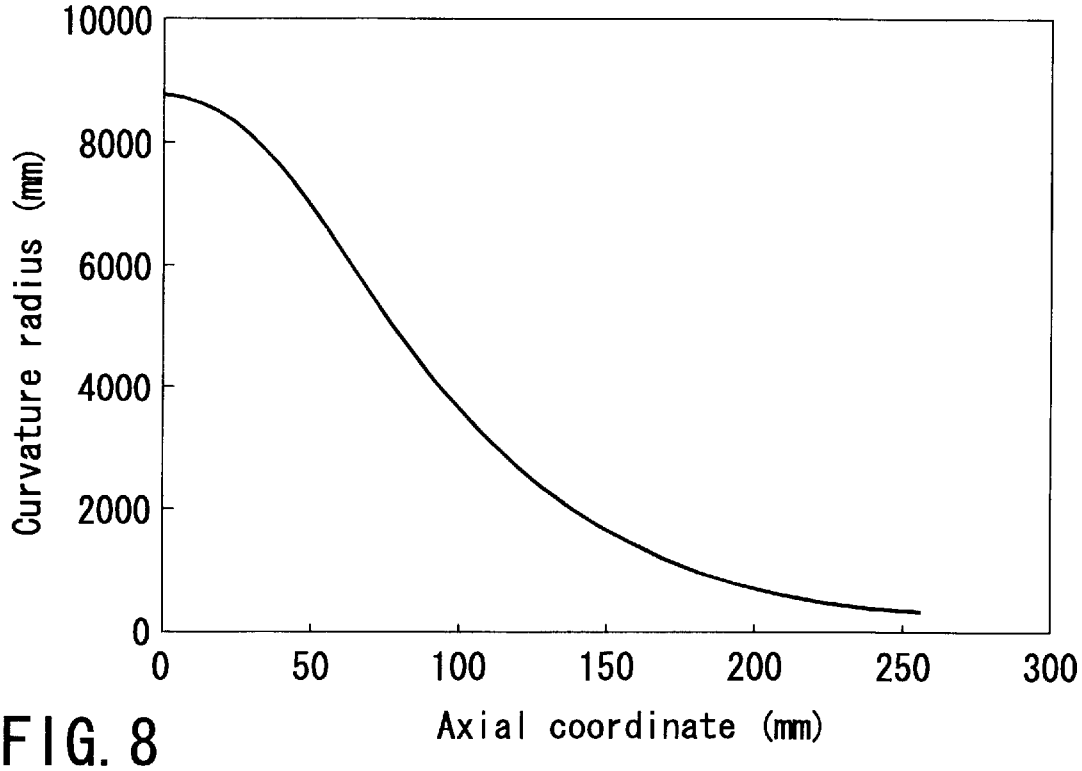
FIG. 8 is a diagram showing the major-axis-direction curvature radius of a shadow mask according to another embodiment on its major axis.
Figure 9:
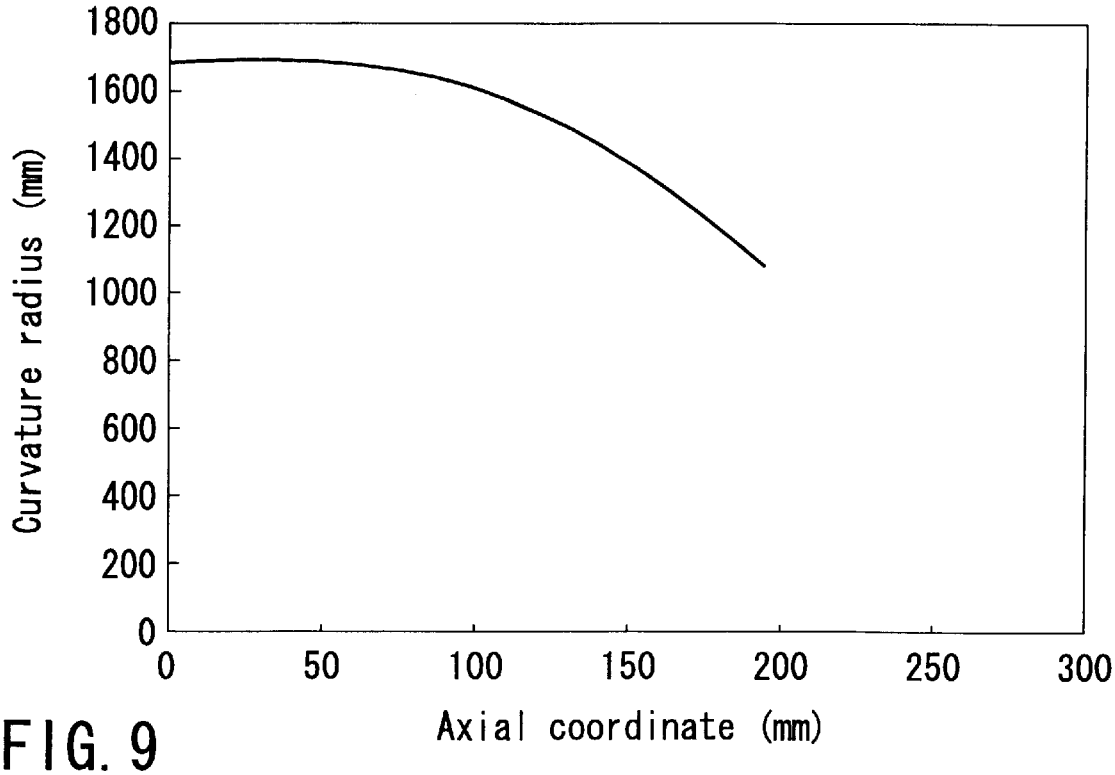
FIG. 9 is a diagram showing the minor-axis-direction curvature radius of the shadow mask of the alternative embodiment on its minor axis.

This example is a shadow mask of a color cathode ray tube designed so that the aspect ratio of the effective portion 1 of the panel 3 is 4:3 and the diagonal length of the screen is 68 cm. FIG. 8 shows the major-axis-direction curvature radius of the effective surface 6 of the shadow mask 9 on the major axis X, and FIG. 9 shows the minor-axis-direction curvature radius on the minor axis Y.

The shadow mask 9 has a configuration such that the average curvature radius in the direction of the minor axis Y that passes the center C of the effective surface 6 is about 0.60 time as long as the average curvature radius in the major-axis direction.

The midpoints in the respective directions of the individual axes and the fall the end portions are set as follows:

(direction of major axis X: distance H from center C to major-axis end=257 mm), depth of depression ZH1 at major-axis-direction midpoint=1.2 mm, fall ZH2 at major-axis-direction end portion=12.1 mm, average major-axis-direction curvature radius RH1 for the range from center C to midpoint=6,881 mm, average major-axis-direction curvature radius RH2 for the range from center C to end portion=2,735 mm, (direction of minor axis Y: distance V from center C to minor-axis end=193 mm), fall ZV1 at minor-axis-direction midpoint=2.7 mm, fall ZV2 at minor-axis-direction end portion=11.4 mm, average minor-axis-direction curvature radius RV1 for the range from center C to midpoint=1,726 mm, average minor-axis-direction curvature radius RV2 for the range from center C to end portion=1,639 mm, (direction of diagonal axis: distance D from center C to diagonal-axis end=321.4 mm), fall ZD1 at diagonal-axis-direction midpoint=4.1 mm, depth of depression ZD2 at diagonal-axis-direction end portion=15.6 mm, average diagonal-axis-direction curvature radius RD1 for the range from center C to midpoint=3,151 mm, and average diagonal-axis-direction curvature radius RD2 for the range from center C to end portion=3,319 mm.

According to this shadow mask, the ratios between the curvature radii in the respective directions of the individual axes are RH1/RH2=2.5 and RV1/RV2=1.1. In this case, the buckling pressure of the shadow mask is 95 Pa, which is higher than the reference value 50 Pa. Thus, the shadow mask has satisfactory curvature retention.

Thus, in either of these color cathode ray tubes, the curvature retention of the shadow mask can be improved. In the color cathode ray tubes having the shadow mask therein, local doming of the shadow mask can be restrained further to improve the visibility of the tube even if the outer surface of the effective portion of the panel is flat.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel having a substantially rectangular effective portion, the effective portion including an outer surface in the form of a substantially flat surface or a curved surface having some curvature;

a phosphor screen on the inner surface of the effective portion;

an electron gun configured to emit electron beams toward the phosphor screen; and a shadow mask located between the phosphor screen and the electron gun, the shadow mask including a substantially rectangular effective surface opposed to the phosphor screen and formed having a number of electron beam passage apertures, the effective surface having a major axis extending at right angles to a tube axis and a minor axis extending at right angles to the tube axis and the major axis and being formed of a curved surface convexed on the phosphor screen side, the effective surface of the shadow mask being formed so as to fulfill relations:

$$2 \leqq RH1/RH2 \leqq 4, \text{ and}$$

$$1 < RV1/RV2 \leqq 1.47,$$

where H is the distance from the center of the effective surface of the shadow mask to the major-axis end portion of the effective surface, RH1 is an average major-axis-direction curvature radius of the effective surface on the major axis defined by a distance H/2 from the center of the effective surface to a midpoint in the major-axis direction and a fall ZH1 of the effective surface in the direction of the tube axis with respect to the center of the effective surface at the major-axis-direction midpoint, RH2 is an average major-axis-direction curvature radius on the major axis defined by a distance H and a fall ZH2 of the effective surface in the direction of the tube axis with respect to the center of the effective surface at the major-axis end portion, V is the distance from the center of the effective surface of the shadow mask to the minor-axis end portion of the effective surface, RV1 is an average minor-axis-direction curvature radius on the minor axis defined by a distance V/2 from the center of the effective surface to a midpoint in the minor-axis direction and a fall ZV1 in the direction of the tube axis with respect to the center of the effective surface at the minor-axis-direction midpoint, and RV2 is an average minor-axis-direction curvature radius on the minor axis defined by a distance V to the minor-axis end portion and a fall ZV2 in the direction of the tube axis with respect to the center of the effective surface at the minor-axis end portion.

2. A color cathode ray tube according to claim 1, wherein the minor-axis-direction curvature radius of the shadow mask on the minor axis monotonously decreases from the center of the effective surface toward the minor-axis end.

3. A color cathode ray tube according to claim 1, wherein the major-axis-direction curvature radius of the shadow mask on the major axis monotonously decreases from the center of the effective surface toward the major-axis end.

4. A color cathode ray tube according to claim 1, wherein the minor-axis-direction curvature radius of the shadow mask on the minor axis monotonously decreases from the center of effective surface toward the minor-axis end, and the major-axis-direction curvature radius of said shadow mask on the major axis monotonously decreases from the center of the effective surface toward the major-axis end.

* * * * *